United States Patent [19]

Rodolpho

[11] 3,998,335

[45] Dec. 21, 1976

[54] DISPLAY RACK

[76] Inventor: Khaled A. Rodolpho, 1047 N. Edgewood, Arlington, Va. 22310

[22] Filed: Sept. 16, 1975

[21] Appl. No.: 613,792

[52] U.S. Cl. ..... 211/49 D; 211/181; 248/175; 312/42

[51] Int. Cl.[2] ..... A47F 5/14

[58] Field of Search ..... 312/9, 42, 45, 49, 72, 312/73; 211/14, 15, 49 R, 49 D, 60 R, 49 S, 71–75, 77, 78, 86, 113, 119, 181; 248/175, 153, 126, 121, 127, 128, 133, 146, 148, 149, 371, 176; 221/282, 284, 285; 220/19; D6/130, 132, 146–149, 157, 85; D9/176, 253, 275, 294; D96/1, 2

[56] References Cited

UNITED STATES PATENTS

| | | | |
|---|---|---|---|
| 2,252,654 | 8/1941 | Webber | 211/49 R |
| 3,150,778 | 9/1964 | Gurian | 211/49 R |
| 3,203,553 | 8/1965 | Pendergrast, Jr. et al. | 211/49 D |
| 3,302,917 | 2/1967 | Winkler | 248/309 |

FOREIGN PATENTS OR APPLICATIONS

| | | | |
|---|---|---|---|
| 113,560 | 7/1941 | Australia | 211/49 S |
| 136,165 | 6/1952 | Sweden | 211/71 |

*Primary Examiner*—Roy D. Frazier
*Assistant Examiner*—Terrell P. Lewis
*Attorney, Agent, or Firm*—Raymond N. Matson

[57] ABSTRACT

An improved display rack of any suitable material for articles of merchandise in containers which is formed of a plurality of spaced sets of concentric rods supported on an inclined base, which is distinctive in appearance and which permits self service with ensuing gravity feed of the containers toward the bottom of the rods.

5 Claims, 3 Drawing Figures

DISPLAY RACK

This invention relates generally to merchandise supports and more particularly to display racks for merchandise containers.

Display racks of many types are well known in the art but most of these are characterized by one or more disadvantageous features. Among these are: a lack of attractiveness in appearance so as to fail to draw a potential customers attention; a difficulty in loading and reloading the rack with containers containing the merchandise; a lack of gravity feed of the containers so as to fail to maintain them at a level convenient to customers; and a complex and unwieldy construction.

Accordingly, the main object of the present invention is to provide a novel display stand of distinctive appearance which will obviate the above and other disadvantageous features characterizing known structures.

An important object of the present invention is to provide a novel display rack of distinctive appearance which is formed of a plurality of parallel rods so spaced as to define gravity feed merchandise container receiving areas therebetween.

A further important object of the present invention is to provide a distinctive display rack of the type described in which the merchandise container supporting rods are spaced both laterally and vertically.

A still further important object of the present invention is to provide a distinctive display rack of the type described in which the merchandise container supporting rods are parallel both laterally and vertically.

Another important object of the present invention is to provide a distinctive display rack of the type described which has a distinctive appearing supporting base formed of rods and provided with a panel which may bear a trademark, advertising indicia, etc.

Another important object of the present invention is to provide a distinctive display rack which is susceptible of ready and economic manufacture, and which is rugged and of long life in use.

Other objects and advantages of the present invention will become apparent during the course of the following description.

In the drawings I have shown several embodiments of the invention. In these showings:

Figure 1:
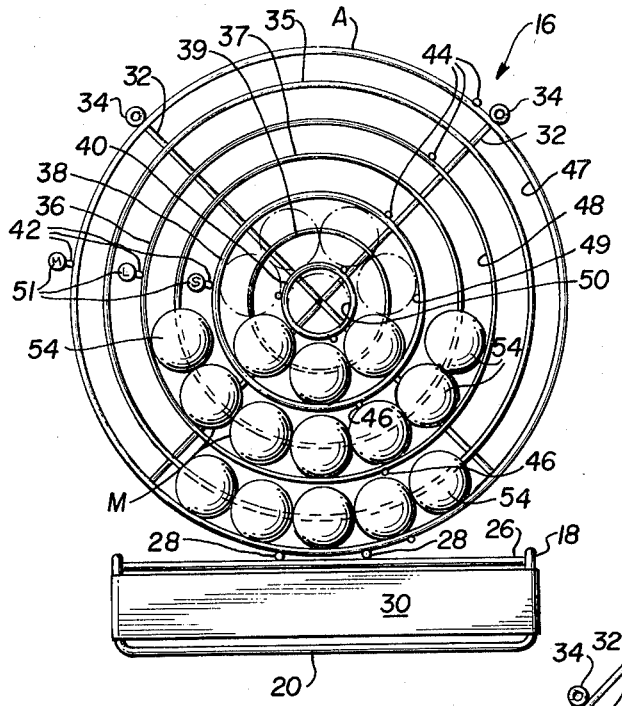
FIG. 1 is a front elevational view of a preferred form of the invention.
Figure 2:
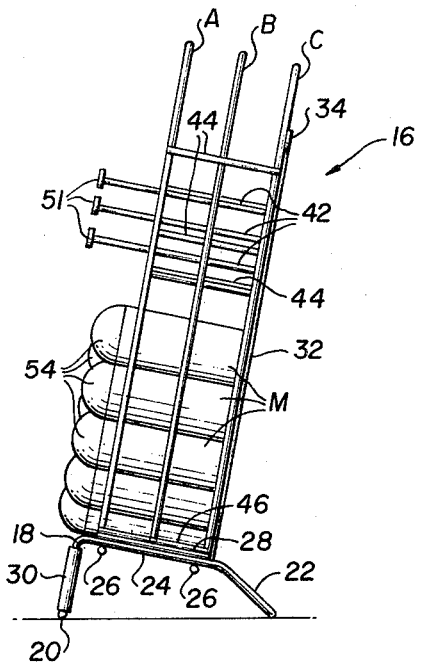
FIG. 2 is a side elevational view thereof.

Referring to FIGS. 1 and 2 of the drawings, numeral 16 designates the display rack as a whole which comprises a supporting base 18, and a plurality of parallel, horizontally spaced, outer rods defining circles A, B and C having a plurality of inner concentric circles to be described.

The base 18 is formed of a rectangular rod loop having a front portion 20 bent vertically downward to form a supporting leg portion and a rearwardly and downwardly inclined leg portion 22 which gives a slight rearward inclination to the intermediate portion 24 which has a pair of transversely extending rods 26 welded thereto which support the rack as a whole by a pair of rods 28. The front leg portion 20 is provided with a panel 30 which may bear a trademark or other identifying indicia, etc.

The circle C is provided with angularly dispoed bracing rods 32 which terminate in apertures 34 at their upper ends so that the rack 16 may be wall-mounted if desired. A plurality of additional, concentric, circle defining rods, 35, 36, 37, 38, 39 and 40, are welded to the bracing rods 32 and act as closures for the rear of the rack which is slightly inclined as previously described. While the rods described are of wire, they may be of any suitable material.

The circles A and B are only provided with concentric circle defining rods 36, 38 and 40 and these are maintained in spaced relation from each other by being welded to supporting rods 42, 44 and 46 which are positioned about 120 degrees from each other. It will be noted that the rods 36, 38 and 40 in the three circles A, B and C define merchandise container receiving spaces 47, 48, 49 and 50 which may be identified as to size, etc. by forward extensions 51 of the supporting rods 42. The containers M are preferably of the type having a transparent forward end 54 so as to disclose to potential customers the color and nature of the merchandise contained therein.

It will now be appreciated that the form of the invention described and disclosed in FIGS. 1 and 2 comprises a strong and light weight, distinctive display rack wherein the horizontally and radially spaced rod circles are rigidly welded in position to define container M receiving spaces which are readily available to a customer for sales purposes, for refilling and for self feeding. The containers may be tubular or any desired shape.

Figure 3:
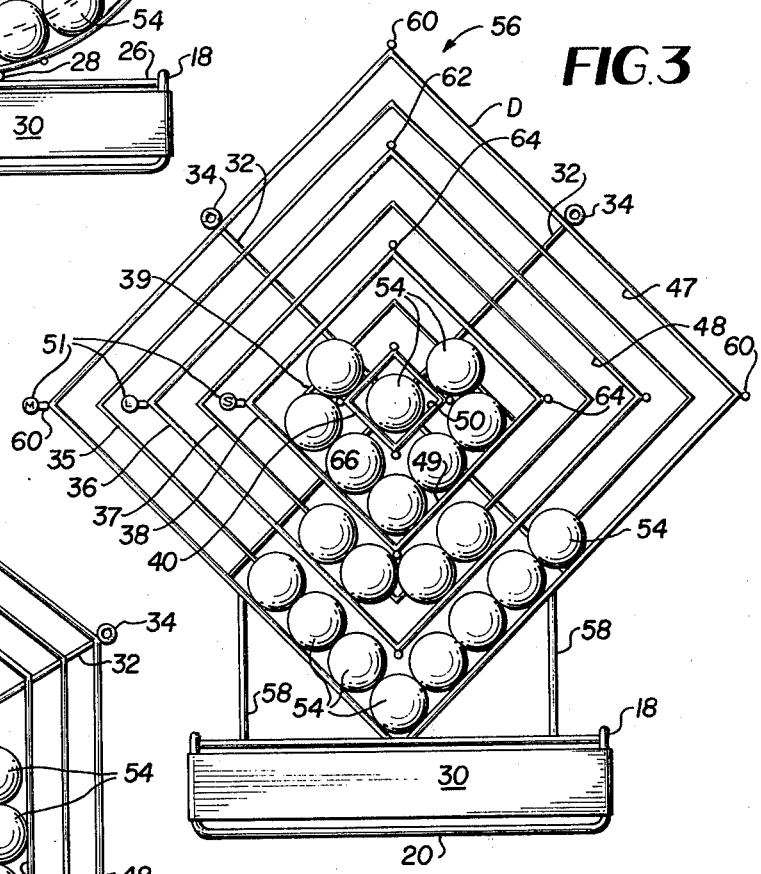
FIG. 3 is a front elevational view of another preferred embodiment of the invention.
Figure 4:
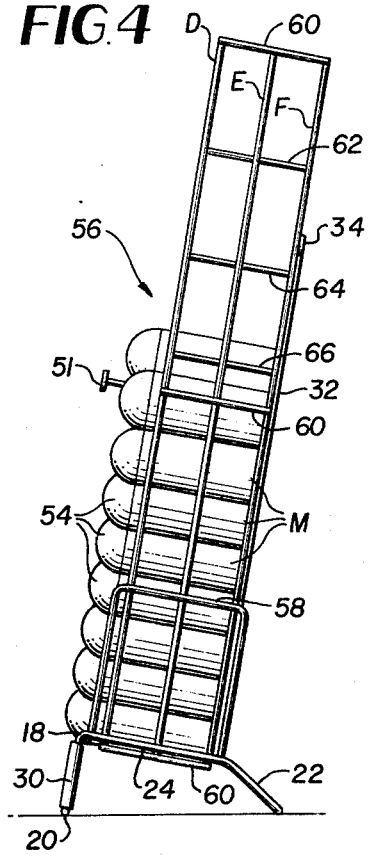
FIG. 4 is a side elevational view thereof.

A very similar display rack structure is disclosed in FIGS. 3 and 4, wherein similar parts are given similar numerals, the essential distinction being that the display rack 56 is square rather than circular. As shown the base 18 has a laterally spaced pair of inverted U-shaped supports 58 welded thereto to receive a lower corner of the square display rack 56 which is angularly oriented at about 45 degrees and welded to the supports 58.

The displays rack 56 comprises three outer horizontally spaced squares D, E and F formed of rods united at their corners by rods 60 which also space the squares front to rear as shown. The rearmost outer square F is provided with bracing rods 32 terminating in eye hangers 34 as before and to these, concentric inner squares 35, 36, 37, 38, 39 and 40 are welded and form a rear closure for the display rack 56. The squares D and E are also provided with the concentric inner squares 36, 38 and 40 which are end connected by rods 62, 64 and 66 and welded to brace rods 32 to define merchandise container receiving spaces 47, 48, 49 and 50.

Figure 5:
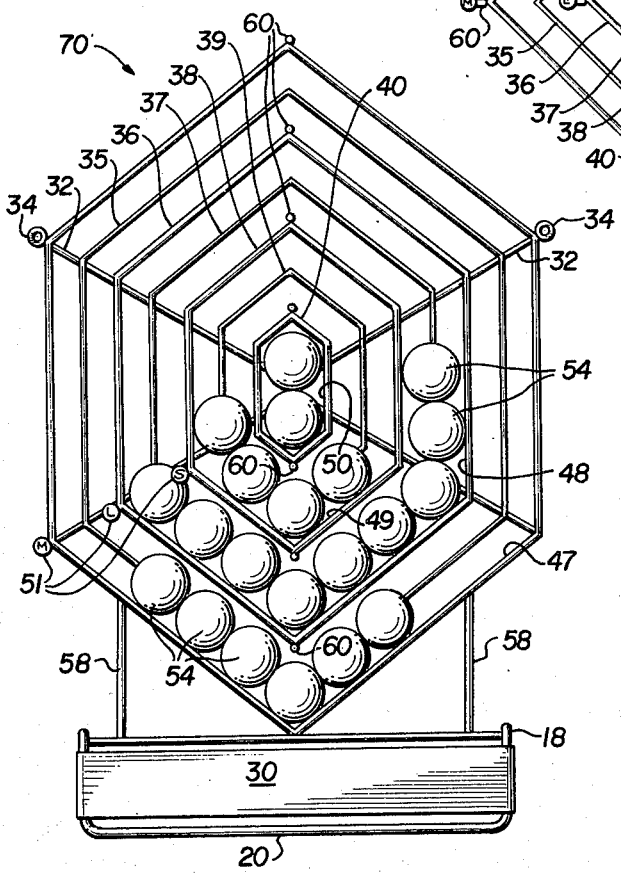
FIG. 5 is a front elevational view of a further preferred embodiment of the invention.
Figure 6:
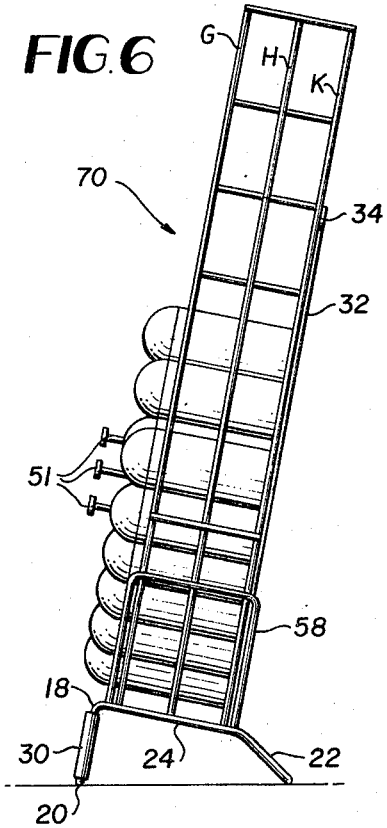
FIG. 6 is a side elevational view thereof.

Another similar display rack structure 70 is disclosed in FIGS. 5 and 6 wherein similar parts are given similar numerals, the essential distinction being that the display rack 70 is hexagonal rather than round or square.

The display rack 70 comprises three outer, horizontally spaced hexagons G, H and K formed of rods welded together and having rods 60 at their upper and lower apexes which rods also space the hexagons front to rear as shown. The rearmost outer hexagon K is provided with bracing rods 32 terminating in eye hangers 34 as before and to these, concentric inner hexagons 35, 36, 37, 38, 39 and 40 are welded and form a rear closure for the display rack 70. The hexagons G and H are also provided with the concentric inner hexagons 36, 38 and 40, which are connected by the rods 60 and welded to brace rods 32 to define merchandise container receiving spaces 47, 48, 49 and 50.

Figure 8:
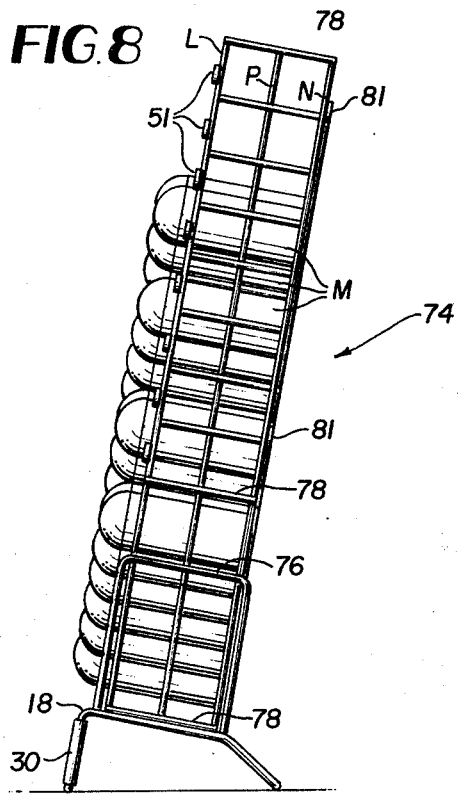
FIG. 8 is a side elevational view thereof.
Figure 7:
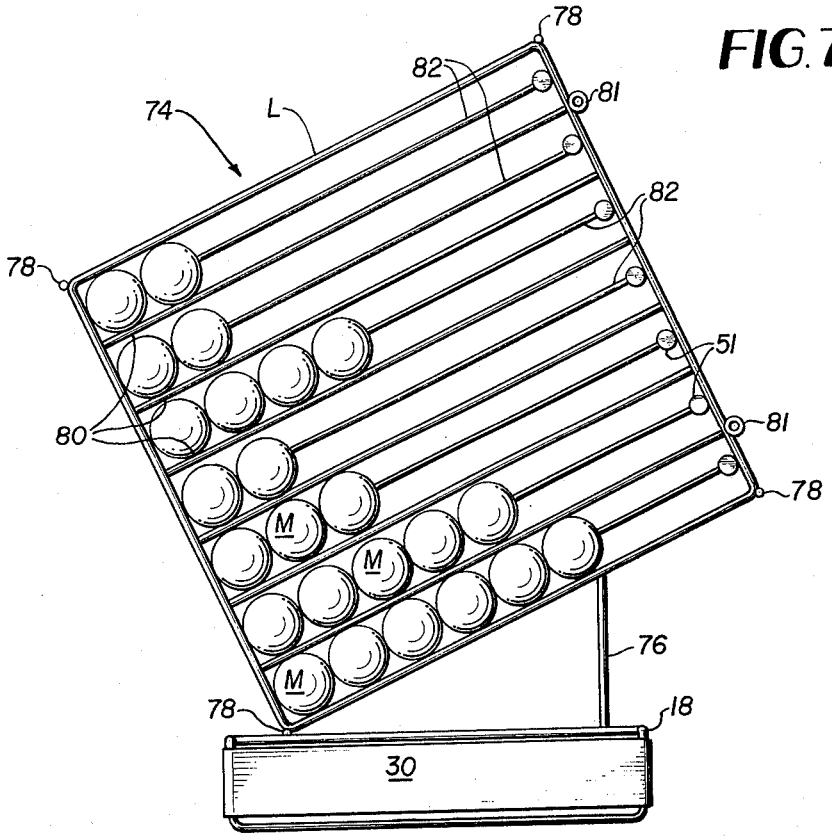
FIG. 7 is a front elevational view of another embodiment of the invention.

Another form of the invention is shown in FIGS. 7 and 8 wherein the display rack 74 is provided with a base 18 having a display panel 30 and an inverted U-shaped support 76 welded thereto. The rack comprises three parallel front to rearwardly spaced rectangles L, P, N formed of rods connected at their corners by welded spacing rods 78. The rack is welded to the base 18 by a lower corner and to the support 76 so as to have an inclined position to enable self feeding of the containers M.

Each of the rectangles L, P and N comprising the rack is provided with a plurality of spaced, parallel rods 80 which define merchandise container receiving compartments and two of the rods terminate in eyes 81 for hanging the rack. In addition, the rearmost rectangle N is provided with an additional set of spaced parallel rods 82 which act to close the rear of the compartments of the rack 74.

Figure 9:
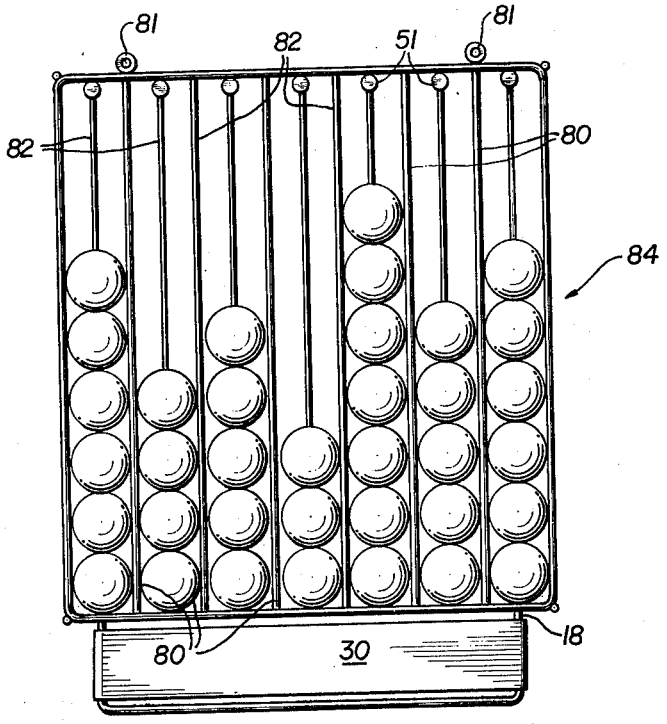
FIG. 9 is a front elevational view of a further embodiment of the invention.
Figure 10:
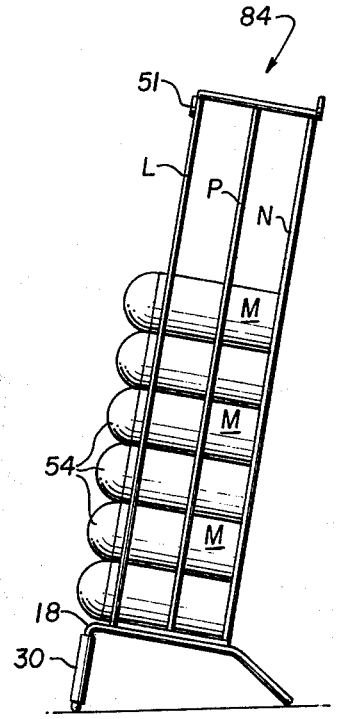
FIG. 10 is a side elevational view thereof.

A further form of the display rack is disclosed in FIGS. 9 and 10 wherein the rack 84 is very similar to the rack disclosed in FIGS. 7 and 8 and like parts have been given like members. As shown, the rack 84 is not inclined laterally but sits squarely on the support 18 so that the rods 80 defining the merchandise container receiving compartments are vertically disposed as are the closure rods 82.

It is to be understood that the forms of my invention herewith shown and described are to be taken as preferred examples of the same and that various changes in the shape, size and arrangement of parts may be resorted to without departure from the spirit of the invention or the scope of the subjoined claims.

What is claimed is:

1. A display rack comprising, in combination, a rearwardly inclined supporting base, a first set of concentric rods mounted on said base substantially normal to the inclination thereof; a second set of concentric rods mounted on said base parallel with and spaced rearwardly of said first set; a plurality of bracing rods joining said second set of concentric rods together; and a plurality of supporting rods extending between and joining together said first and second sets of concentric rods together, said supporting rods extending parallel to the inclination of the base.

2. The combination recited in claim 1 wherein said concentric rods define circles.

3. The combination recited in claim 1 wherein said concentric rods define squares.

4. The combination recited in claim 1 wherein said concentric rods define hexagons.

5. The combination recited in claim 1 wherein said base is inclined rearwardly and said second set of rods includes means for preventing passage of containers through the rear of said rack.

* * * * *